US005634676A

United States Patent [19]

Feder

[11] Patent Number: 5,634,676

[45] Date of Patent: Jun. 3, 1997

[54] POWER DOOR LOCK ACTUATOR

[76] Inventor: David A. Feder, 22821 Overlake, St. Clair Shores, Mich. 48080

[21] Appl. No.: 523,114

[22] Filed: Sep. 1, 1995

[51] Int. Cl.[6] ..... E05C 1/12

[52] U.S. Cl. ..... 292/201; 70/264; 70/275; 70/277; 70/279; 292/144; 292/336.3

[58] Field of Search ..... 70/279, 264, 277, 70/280, 283; 292/201, DIG. 62, 347, 348, 353, 354, 336.3; 403/77, 76, 141, 142, 143, 122

[56] References Cited

U.S. PATENT DOCUMENTS

| | | | |
|---|---|---|---|
| 1,337,235 | 4/1920 | Kuhn | 403/143 |
| 1,431,290 | 10/1922 | Daggett, Jr. | 403/77 |
| 1,740,971 | 12/1929 | Corlett | 403/122 |
| 2,706,967 | 4/1955 | Iannetti | 403/143 |
| 2,859,060 | 11/1958 | Davies et al. | 403/122 |
| 2,999,712 | 9/1961 | Jakeway | 292/336.3 |
| 3,143,365 | 8/1964 | Egger | 403/77 |
| 3,154,333 | 10/1964 | Townsend | 403/122 |
| 3,385,620 | 5/1968 | Porvin | 292/336.3 |
| 4,059,360 | 11/1977 | Teissier | 403/141 |
| 4,135,377 | 1/1979 | Kleefeldt et al. | 20/280 |
| 4,200,405 | 4/1980 | Bauer | 403/142 |
| 4,269,440 | 5/1981 | Gelhard . | |
| 4,290,634 | 9/1981 | Gelhard . | |
| 4,478,531 | 10/1984 | Levinson et al. | 403/77 |
| 4,573,723 | 3/1986 | Morita et al. | 70/279 |
| 4,617,812 | 10/1986 | Rogers | 70/280 |
| 4,674,781 | 6/1987 | Reece et al. . | |
| 4,708,378 | 11/1987 | Igenhoven . | |
| 4,793,640 | 12/1988 | Stewart, Sr. | 292/336.3 |
| 4,819,493 | 4/1989 | Dornan . | |
| 4,821,521 | 4/1989 | Schuler | 70/279 |
| 4,885,922 | 12/1989 | Lutz . | |
| 4,893,704 | 1/1990 | Fry et al. . | |
| 4,932,690 | 6/1990 | Kleefeldt et al. | 292/201 |
| 4,978,155 | 12/1990 | Kobayashi . | |
| 5,037,145 | 8/1991 | Wilkes . | |
| 5,079,964 | 1/1992 | Hamada et al. | 292/201 |
| 5,137,312 | 8/1992 | Tang | 292/201 |
| 5,328,218 | 7/1994 | Brusasco . | |
| 5,441,315 | 8/1995 | Kleefeldt et al. | 70/264 |
| 5,472,065 | 12/1995 | Vergin | 292/201 |
| 5,526,710 | 6/1996 | Ohta | 292/201 |

FOREIGN PATENT DOCUMENTS

| | | | |
|---|---|---|---|
| WO89/10458 | 11/1989 | WIPO | 292/144 |

OTHER PUBLICATIONS

Picture of internal components of a power door lock actuator of Ford Motor Co., Dearborn, MI, believed dated before Sep. 1, 1994.

Picture of internal components of a power door lock actuator of Chrysler Corporation, Highland Park, MI, believed dated before Sep. 1, 1994.

Power Door Lock Actuator of Rockwell Corp, Troy, MI; on Market Since at Least Before Sep. 1, 1994.

Power Door Lock Actuator of Kelsey Hayes Co., Romulus, MI; on Market Since at Least Before Sep. 1, 1994.

Power Door Lock Actuator of General Motors Corp., Detroit, MI; Built by ITT Automotive, Rochester NY; on Market Since at Least Before Sep. 1, 1994.

*Primary Examiner*—Steven N. Meyers
*Assistant Examiner*—Stephen J. Pentlicki
*Attorney, Agent, or Firm*—Peter D. Keefe

[57] ABSTRACT

A power door lock actuator including: a housing; a bi-directional electric motor; a threaded shaft drivingly connected with the drive shaft of the motor; a drive armature threadingly engaged with the threaded shaft, wherein the drive armature has a first abutment at its distal end; a driven armature which is axially slidable relative to the drive armature over a preset distance of travel determined by a second abutment at its distal end and a third abutment spaced the preset distance from the distal end; a first spring which biases the drive armature toward a one end of the threaded shaft; and a second spring which biases the drive armature toward the other end of the threaded shaft When the motor is not operating the first and second springs cooperate to biasably locate the drive armature to a neutral position so that lost motion travel of the driven armature with respect to the drive armature is provided and the motor is not back-driven whenever the lock mechanism is manually actuated.

14 Claims, 3 Drawing Sheets

POWER DOOR LOCK ACTUATOR

BACKGROUND OF THE INVENTION

1. Field of the Invention

The present invention relates to electrically actuated power door locks for automotive vehicles. More particularly, the present invention relates to a power door lock actuator of the motor drive type which provides increased reliability and improved mechanical function as compared to prior power door lock actuators.

2. Description of the Related Art

Power door locks have become ubiquitous in motor vehicles, especially with the advent of remote engine systems. Power door locks provide electrical actuation of the door lock mechanism of a motor vehicle in response to a user pressing a switch.

There are two basic mechanisms that can provide power door lock actuation: a solenoid and a motor drive. Because solenoids are frequently noisy and sometimes actuation is unreliable, motor drives have become the actuator of choice.

Various motor drive type door lock actuators have been proposed and installed on production motor vehicles. A motor drive typically includes an electric motor, a gear set and an actuation mechanism responsive to the electric motor via the gear set. Problematical, however, is the situation when the user uses his or her key to unlock his or her car door lock, since the motor drive would then be back-driven and thereby offer unacceptable resistance to turning the key. This situation also arises when the user manually actuates the door lock button on the door. It has become known that a solution to the problem of the motor drive being back driven during manual and key operation of the door lock is to provide "lost motion" in the motor drive.

Following are descriptions of some interesting prior motor type door lock actuators. U.S. Pat. No. 4,819,493 describes the use of an inertial clutch to couple a rack and pinion gear set to the motor only when the motor is operating. U.S. Pat. No. 4,674,781 describes another rack and pinion gear set having a lost motion coupling wherein a pair of opposing springs return the rack to a neutral position between spaced apart, opposing abutments when the motor is turned off. Finally, U.S. Pat. No. 4,893,704 describes main and secondary threaded shafts with opposed threads that cooperate to axially move a drive member, wherein lost motion is provided by pins running free in a slot until one end or the other of the slot is encountered.

In spite of the many attempts in the art to provide an acceptable power door lock actuator, there yet remains needed a mechanically simple and reliable power door lock actuator which also solves the back driving problem when the door lock mechanism is manually actuated.

SUMMARY OF THE INVENTION

The present invention is an electrically actuated power door lock actuator which provides long term reliability, minimal mechanical complexity and solves the problem of back driving when the door lock mechanism is manually actuated.

The power door lock actuator according to the present invention includes: a housing; a bi-directional electric motor; a threaded shaft drivingly connected with the drive shaft of the motor; a drive armature threadingly engaged with the threaded shaft, wherein the drive armature has a first abutment at its distal end; a driven armature which is axially slidable relative to the drive armature over a preset distance of travel determined by a second abutment at its distal end and a third abutment spaced the preset distance from the distal end; a first spring which biases the drive armature toward a second end of the threaded shaft; and a second spring which biases the drive armature toward a first end of the threaded shaft When the motor is not operating the first and second springs cooperate to biasably locate the drive armature to a neutral position.

Operation will now be described with an assumed direction of actuation of the door lock mechanism; should a particular door lock mechanism actuate from state to state in an opposite direction of actuation, then the movements described hereinbelow would be reversed.

In operation when a user wishes to change the door lock from the unlocked to the locked state, the user presses an electrical switch one way, the motor then becomes operative in a first direction of rotation and turns the threaded shaft in a first direction. The threaded shaft then threads with respect to the drive armature, causing it to move axially toward the first end of the threaded shaft, During this movement, the first spring is compressed and the first and second abutments interact to thereby cause the driven armature to move with the drive armature, thereby moving a connector which, in turn, actuates the lock mechanism to the locked state. When the electrical switch is released, the first spring will cause the drive armature to return to the neutral position (as also defined by coaction with the second spring), whereupon the door lock may be actuated manually by button or key with only the driven armature moving (ie., the drive armature is disconnected).

In operation when a user wishes to change the door lock from the locked to the unlocked state, the user presses an electrical switch another way, the motor then becomes operative in a second direction of rotation and turns the threaded shaft in a second direction. The threaded shaft then threads with respect to the drive armature, causing it to move axially toward the second end of the threaded shaft, During this movement, the second spring is compressed and the first and third abutments interact to thereby cause the driven armature to move with the drive armature, thereby moving a connector which, in turn, actuates the lock mechanism to the unlocked state. When the electrical switch is released, the first spring will cause the drive armature to return to the neutral position (as also defined by coaction with the first spring), whereupon the door lock may be actuated manually by button or key with only the driven armature moving (ie., the drive armature is disconnected).

Accordingly, it is an object of the present invention to provide a power door lock actuator having few mechanical parts, high reliability and freedom from back driving when the door lock is manually actuated.

It is another object of the present invention to provide a power door lock actuator which operates on a threaded shaft principle, wherein lost motion is an inherent feature of interactive movement between drive and driven armatures.

It is an additional object of the present invention to provide a power door lock actuator which operates on a threaded shaft principle, wherein lost motion is provided by spaced apart, opposing abutments, whereby opposing springs reposition the drive armature to a selected neutral position between the abutments when electrical power is turned off so that the driven armature is freely movable with respect to the drive armature over a preset distance of travel which is at least equal to the distance of travel of the door lock mechanism when manually actuated.

It is a further object of the present invention to provide a power door lock actuator wherein an actuator rod is pivotally mounted thereto for providing tiltable connection to the door lock mechanism so as to obviate stress on components of the power door lock actuator when the actuator rod tilts off axis.

These, and additional objects, advantages, features and benefits of the present invention will become apparent from the following specification.

DETAILED DESCRIPTION OF THE PREFERRED EMBODIMENT

Figure 1:
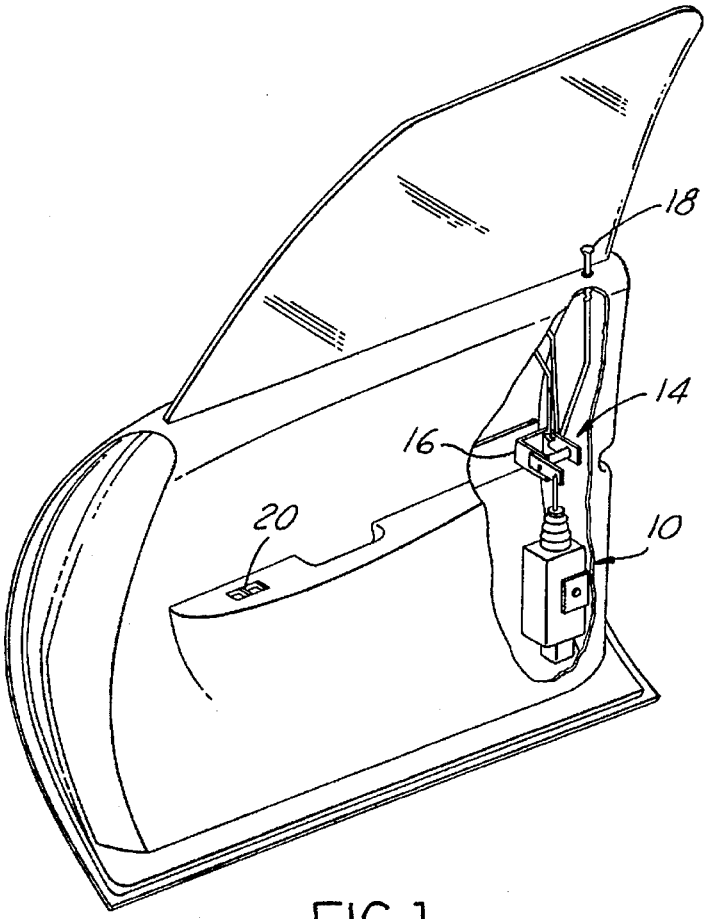
FIG. 1 is a broken away perspective view of a motor vehicle door equipped with the power door lock actuator according to the present invention.
Figure 2:
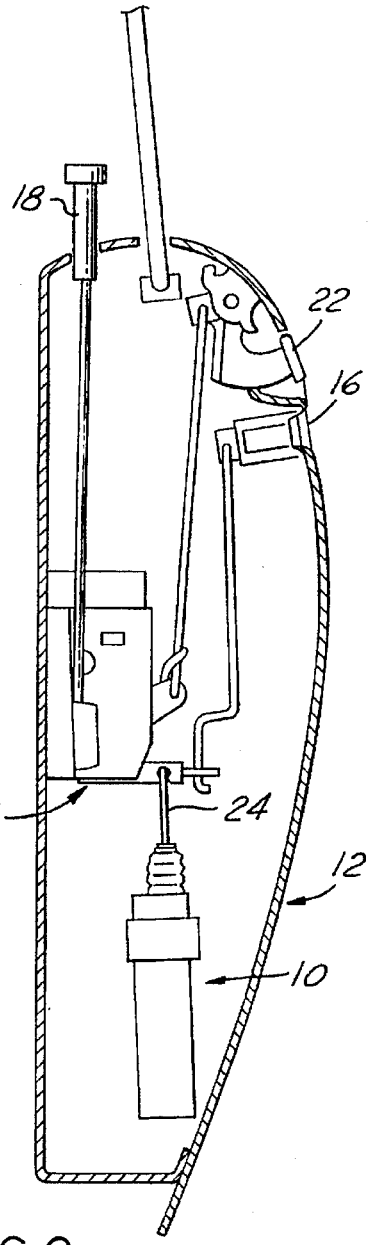
FIG. 2 is a partly sectional side view of the motor vehicle door equipped with the power door lock actuator according to the present invention.

Referring now to the Drawing, FIGS. 1 and 2 show the power door lock actuator 10 according to the present invention in operation within a door 12 of a motor vehicle. In this regard, the door 12 is equipped with a door lock mechanism 14 which is actuable between a locked state and an unlocked state. The door lock mechanism 14 has two manual actuation modalities: a key actuation modality 16 and a button actuation modality 18. The door lock mechanism 14 further has a power actuation modality provided by the power door lock actuator 10 which is actuated by electrical power of the motor vehicle via a two position electrical switch 20. The door lock mechanism 14 is connected with a door handle 22, wherein operation thereof provides opening of the door 12.

In operation, when a user wishes to effect changing the door lock state from unlocked to locked, he or she presses the electrical switch 20 to a first position whereupon motor vehicle electrical power is supplied to the power door lock actuator 10. The power door look actuator 10 then causes an actuator rod 24 which is linked to the door look to move appropriately up or down to thereby cause the door lock to assume the looked state. When the user wishes to effect changing the door lock state from locked to unlocked, he or she presses the electrical switch 20 to a second position whereupon motor vehicle electrical power is supplied to the power door lock actuator 10. The power door lock actuator 10 then causes an actuator rod 24 which is linked to the door lock to move appropriately in the other direction to thereby cause the door lock to assume the unlocked state. Internally to the power door lock actuator 10, an advantageous and novel lost motion mechanism is provided whereby the user may manually actuate the door lock mechanism 14 without resistance thereto from the power door lock actuator 10, the nature of which will be disclosed in detail hereinbelow.

The structure and function of the power door look actuator 10 will now be detailed with greater specificity, with reference now being additionally directed to the remaining figures.

The power door lock actuator 10 includes a housing 26 which is connected in a conventional manner to the motor vehicle door structure. A preferred material for the housing 26 is plastic. Mounted within the housing 26 is a bi-directional electric motor 28. The electric motor 28 preferably includes an internal thermistor (or other overload protector) to prevent overloading. An example of an acceptable electric motor 28 are models FC-280PT/ST manufactured by Mabuchi Motor of Japan. An electrical connector 30 is provided for conventionally connecting to an electrical circuit which includes the electrical switch 20 and the electrical system of the motor vehicle.

Figure 7:
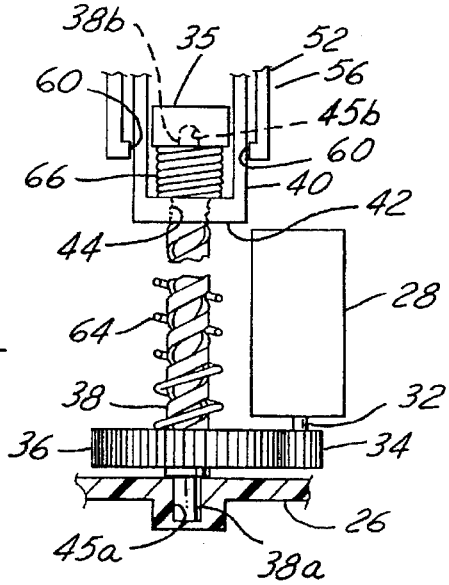
FIG. 7 is a partly broken away, partly sectional detail side view of the drive mechanism of the power door lock actuator according to the present invention.

As best seen in FIG. 7, the electric motor 28 has a drive shaft 32 to which is connected to a drive gear 34. The drive gear 34 is gearingly meshed with a driven gear 36. The driven gear 36 is connected to a threaded shaft 38. The threaded shaft 38 has a first end **38*a* and an opposite second end 38*b*. The first end 38*a* is rotatably seated in a first seat 45*a* formed in the housing 26, and the second end 38*b* is rotatably seated in a second seat 45*b* formed in a tab 35 of the housing 26. The driven gear 36 is located adjacent the first seat 45*a*. Accordingly, when the electric motor 28 is operating, the drive and driven gears 32, 34 cause the threaded shaft 38** to rotate.

A U-shaped drive armature 40 is threadably engaged with the threaded shaft 38. In this regard, a head 42 of the drive armature 40 has a threaded hole 44 which is threading engaged with the threaded shaft 38. Accordingly, when the threaded shaft 38 rotates, the head 42 of the drive armature 40 will either axially thread up or down the threaded shaft depending upon its direction of rotation. The drive armature 40 is prevented from rotating with the threaded shaft by axially slidable abutment of the drive armature with the sides 46 of the housing 26 (one side being shown in FIGS. 3 through 6). A pair of drive armature arms **65*a*, 65*b* (see FIG. 8) are axially aligned with the threaded shaft 38 and connect with the head 42 to thereby form the drive armature 40. The distal end 48 of each of the drive armature arms 65*a*, 65*b* is provided with an outwardly facing first abutment 50**.

A driven armature 52 includes an upper portion 55 and a lower portion 56. The upper portion 55 is reciprocably guided within a neck 54 of the housing 26. The driven armature 52 is prevented from rotating by axially slidable abutment with the sides 46 and the neck 54 of the housing 26. The lower portion 56 is U-shaped and characterized by a pair of driven armature arms 75*a*, 75*b* (see FIG. 8). The distal end 58 of each of the driven armature arms 75*a*, 75*b* is provided with an inwardly facing second abutment 60. The driven armature arms 75*a*, 75*b* connect with the upper portion 55 so as to provide a third abutment 62 therebetween.

Figure 8:
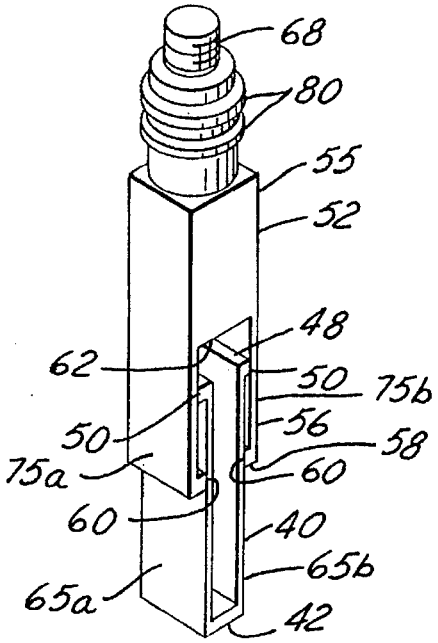
FIG. 8 is a detail perspective view of the drive and driven armatures according to the present invention.
Figure 9:
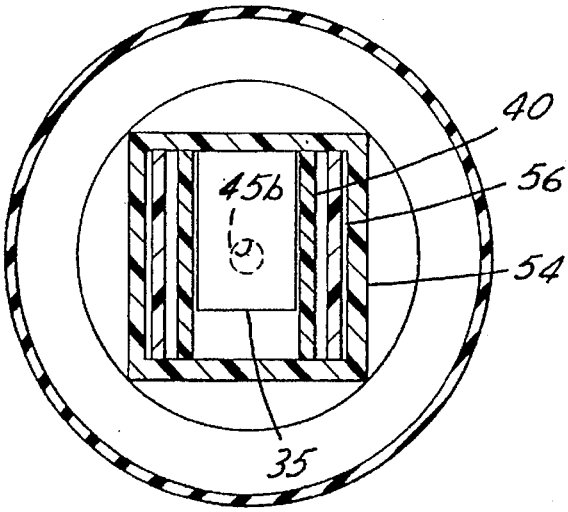
FIG. 9 is a partly sectional plan view of the power door lock actuator according to the present invention, seen along line 9—9 in FIG. 3.

As shown in FIG. 8, the lower portion 56 of the driven armature 52 axially receives the threaded shaft 38 and the drive armature 40 such that the first and second abutments 50, 60 are mutually opposing and overlapping. Consequently, the first abutments 50 have limited travel distance defined between the second and the third abutments 60, 62. This travel distance provides a "lost motion" travel distance $T_1$, $T_2$ for the driven armature 52 as will become clearer from the description thereof hereinbelow.

Figure 6:
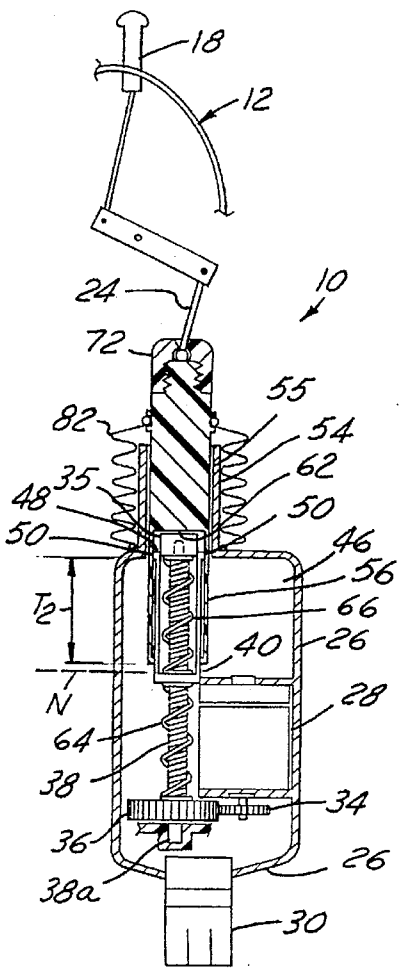
FIG. 6 is a partly sectional side view of the power door lock actuator according to the present invention, shown in a configuration whereat the first spring has moved the drive armature to the neutral position (as defined by coaction with the second spring) after completion of actuation of the unlock state of a door lock.
Figure 5:
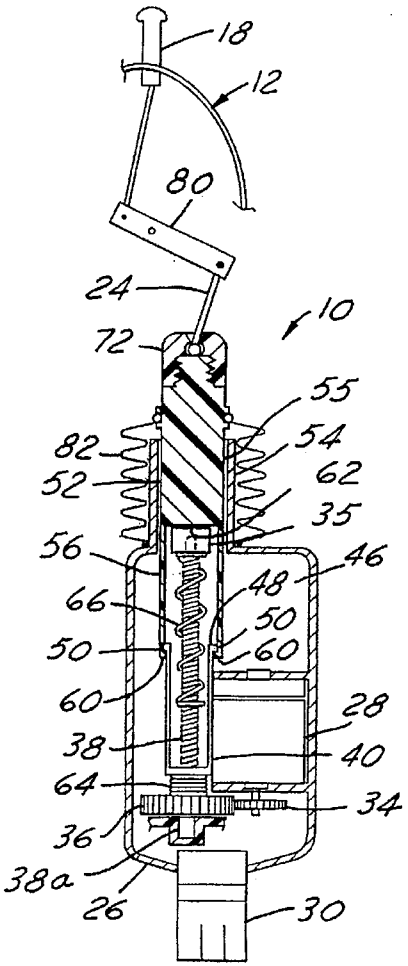
FIG. 5 is a partly sectional side view of the power door lock actuator according to the present invention, shown in a configuration whereat actuation of the unlock state of a door lock has just been completed.
Figure 4:
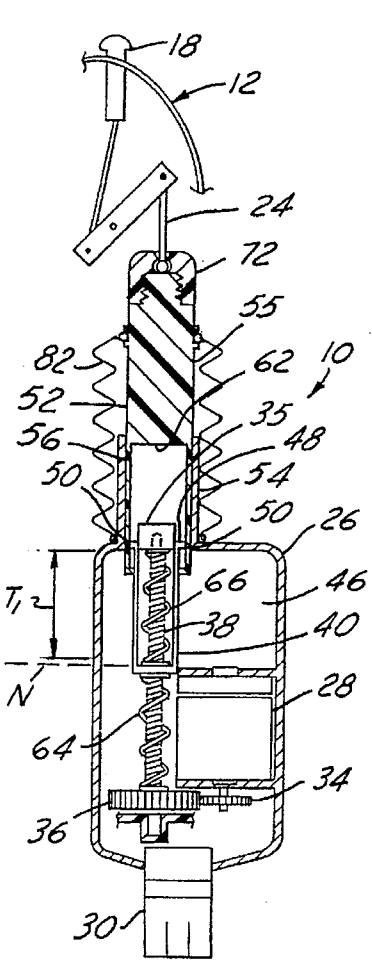
FIG. 4 is a partly sectional side view of the power door look actuator according to the present invention, shown in a configuration whereat the second spring has moved the drive armature to the neutral position (as defined by coaction with the first spring) after completion of actuation of the lock state of a door lock.
Figure 3:
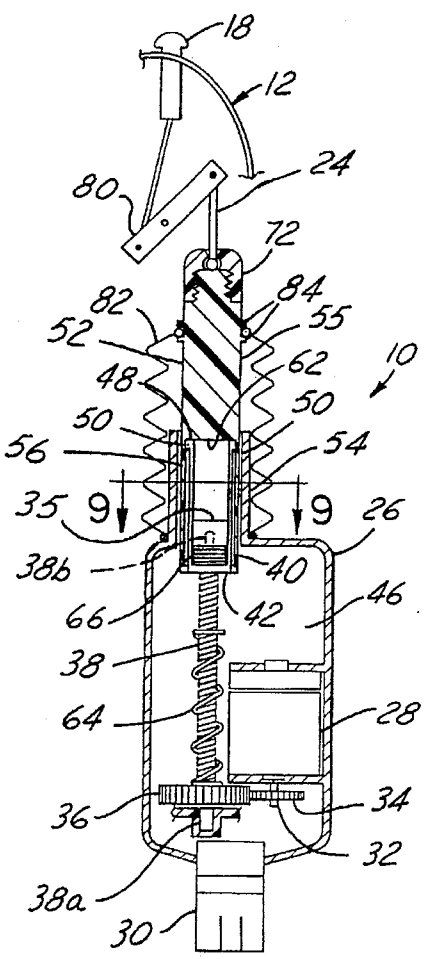
FIG. 3 is a partly sectional side view of the power door lock actuator according to the present invention, shown in a configuration whereat actuation of the lock state of a door lock has just been completed.

A first coil spring 64 is trapped between the driven gear 36 and the head 42 of the drive armature 40. A second coil spring 66 is trapped between the tab 35 and the head 42. Each of the springs 64, 66 is preferably of equal length and has sufficient, preferably equal, resilient spring tension to cause the head 42 of the drive armature 40 to be located neutrally therebetween (ie., substantially midway between the tab and the driven gear) when the electric motor 28 is not operating. In this regard, as the springs 64, 66 cause the head 42 to reach neutrality, the threaded shaft 38 is caused to rotate, thereby back-driving the electric motor 28 through the drive and driven gears 34, 36. At the neutral position N, as shown in FIGS. 4 and 6, a user can actuate the door lock mechanism 14 manually via a key or the button and no back-driving of the electric motor will occur thereduring, as only the driven armature 52 will move, since the second and third abutments 60, 62 thereof will not encounter the first abutments 50 during this movement (which is less than the aforementioned "lost motion" travel distance $T_1$, $T_2$).

Figure 10:
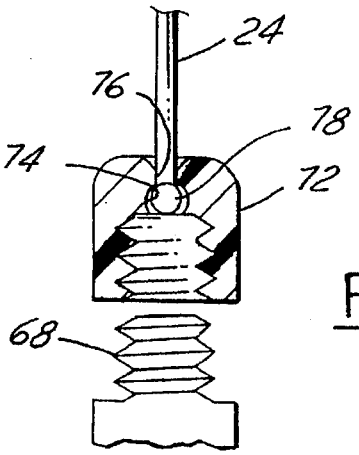
FIG. 10 is a detail, partly sectional side view of a preferred connection modality for the actuator rod.

At the crown 68 of the driven armature 52, the actuator rod 24 is connected thereto. In this regard as shown in FIG. 10, it is preferred to provide a cap 72 attached removably, such as preferably by threads, to the driven armature 52, but the connection of the cap may by another modality, such as a quick disconnect interconnection or crimping. The cap 72 has a hollow internal socket 74 and an outwardly flaired aperture 76 communicating therewith which traps a bulbous portion 78 of the actuator rod so as to let the actuator rod to freely tilt with respect to the crown 68. This structure, wherein the actuator rod is pivotally connected to the driven armature 52, is preferred because it allows for easy and inexpensive replacement of a defective actuator rod, and further allows for the actuator rod to tilt in relation to the axis of movement of the driven armature as may be requested to avoid stress with respect to changing alignment with another part, such as a swivel member 80, of the door lock mechanism as the driven armature is moved axially from one position to another by axial movement of the drive armature.

The crown 68 of the driven armature also includes preferably a pair of lips 84 which engage an upper portion of an elastomeric boot 82, which is resiliently fitted to the neck 54 of the housing 26.

Operation will now be detailed with reference being particularly directed to FIGS. 3 through 6. It will be understood that an assumed direction of movement of the drive armature causes an assumed actuation of the door lock mechanism from one state to another, which is presented hereinbelow by way of example only; the reversal of these movements would be applicable to another particular door lock mechanism, wherein the states thereof are actuated by movement directions in reverse of the below described movements.

A. Unlocked State to Locked State, FIGS. 6, 3 and 4

The power door lock actuator 10 is initially in the configuration shown in FIG. 6, wherein the head 42 of the drive armature 40 is at the neutral position N.

To change the door lock mechanism 14 from the unlocked to the locked state, the user presses the electrical switch 20 to a first position, the electric motor 28 then becomes operative in a first direction of rotation and, via the drive and driven gears 34, 36, turns the threaded shaft 38 in a first direction. The threaded shaft then threads with respect to the head 42 of the drive armature 40, causing it to move axially toward the second end 38*b* of the threaded shaft During this movement, the second spring 66 is compressed and the first abutments 50 and the third abutment 62 abuttingly interact to thereby cause the driven armature 52 to move with the drive armature, thereby moving the connector rod 24 which, in turn, actuates the door lock mechanism 14 to the locked state. When the electrical switch 20 is released, the second spring 66 causes the drive armature 40 to return to the neutral position, as defined also by the first spring 64 coacting therewith, whereby the threaded shaft 38 rotates (and thereduring back drives the electric motor 28), whereupon the door lock mechanism 14 may be actuated manually by button or key without thereduring back-driving of the electric motor and only the driven armature 52 moving due to the "lost motion" travel $T_1$, as depicted in FIG. 4.

B. Locked State to Unlocked State, FIGS. 4 through 6

The power door lock actuator 10 is initially in the configuration shown in FIG. 4, wherein the head 42 of the drive armature 40 is at the neutral position N.

To change the door lock mechanism 14 from the locked to the unlocked state the user presses an electrical switch 20 to a second position, the electric motor 28 then becomes operative in a second direction of rotation and, via the drive and driven gears 34, 36, turns the threaded shaft 38 in a second direction. The threaded shaft then threads with respect to the head 42 of the drive armature 40, causing it to move axially toward the first end 38*a* of the threaded shaft, During this movement, the first spring 64 is compressed and the first and second abutments 50, 60 abuttingly interact to thereby cause the driven armature 52 to move with the drive armature 40, thereby moving the connector rod 24 which, in turn, actuates the door lock mechanism 14 to the unlocked state. When the electrical switch 20 is released, the first spring 64 causes the drive armature to return to the neutral position, as defined also by the first spring 64 coacting therewith, whereby the threaded shaft 38 rotates (and thereduring back drives the electric motor 28), whereupon the door lock mechanism 14 may be actuated manually by button or key without back-driving of the electric motor thereduring and only the driven armature 52 moving due to the "lost motion" travel $T_2$, as depicted in FIG. 6.

To those swilled in the art to which this invention appertains, the above described preferred embodiment may be subject to change or modification. For example, the embodiment described herein is to be merely considered a best mode for carrying out the invention, and that many other embodiments can be envisioned based upon the principles described herein for adapting the present invention to the particulars associated with the door lock mechanisms and power door lock actuators therefor of the various vehicles of the various original equipment automotive manufacturers. Such change or modification can be carried out without departing from the scope of the invention, which is intended to be limited only by the scope of the appended claims.

What is claimed is:

1. A power door lock actuator for actuating a door lock mechanism, comprising:

a housing;

a bi-directional electric motor located in said housing;

connection means provided on said housing for connecting said electric motor to an external electrical circuit;

a threaded shaft rotatably connected with said housing, said threaded shaft having a first end and an opposite second end;

drive means for drivingly connecting said electric motor to said threaded shaft so that said electric motor provides rotation of said threaded shaft;

a drive armature axially aligned with said threaded shaft, said drive armature having head means for threadingly engaging said threaded shaft;

first abutment means located on said drive armature for providing an abutment;

a driven armature axially aligned with said threaded shaft;

second abutment means located at a first predetermined location on said driven armature for providing an abutment;

third abutment means located at a second predetermined location on said driven armature for providing an abutment, wherein said first and second predetermined locations are spaced a preselected distance apart to thereby provide a lost motion distance therebetween; and biasing means for biasing said drive armature in a first direction axially aligned with said threaded shaft and for biasing said drive armature in a second direction that is opposite said first direction, said biasing means biasing said drive armature toward a preselected neutral position;

wherein selected actuation of said electric motor causes selected rotation of said threaded shaft whereupon said drive armature threads with respect to said threaded shaft thereby selectively moving said drive armature axially with respect to said threaded shaft during which movement said biasing means is resiliently biased and said first abutment means abuts with one of said second and third abutment means so that said driven armature selectively moves with said drive armature; and wherein when said actuation of said electric motor ceases, said resilient biasing of said biasing means biasably repositions said drive armature to said neutral position, whereat said driven armature is freely axially movable with respect to said drive armature over said lost motion distance;

wherein said drive armature comprises two parallel and mutually spaced apart drive armature arms connected with said head means, wherein said threaded shaft is received between said drive armature arms, further wherein each of said drive armature arms has a distal end remote from said head means, said first abutment means being located at said distal end of each of said drive armature arms; and wherein said driven armature comprises an upper and a lower portion, wherein said lower portion comprises two parallel and mutually spaced apart driven armature arms connected with said upper portion at said third abutment means, wherein said threaded shaft is received between said driven armature arms, further wherein each of said driven armature arms has a distal end remote from said third abutment means, said second abutment means being located at said distal end of each of said driven armature arms.

2. The power door lock actuator of claim 1, further comprising:

actuator rod means for connecting said driven armature to a door lock mechanism; and pivot connector means for pivotally connecting said actuator rod means to said driven armature.

3. The power door lock actuator of claim 1, wherein said drive armature arms are received between said driven armature arms.

4. The power door lock actuator of claim 1, wherein said lost motion distance is defined by said driven armature moving with respect to said drive armature a distance defined by said first abutment means being relatively movable between said second and third abutment means.

5. The power door lock actuator of claim 4, wherein said biasing means comprises:

a first spring; and a second spring;

wherein said first and second springs opposingly bias against said head means to thereby biasably position said head means at said neutral position.

6. The power door lock actuator of claim 5, wherein said first, second and third abutment means are relatively located when said head means is at said neutral position such that said selected movement of said drive armature in response to actuation of said electric motor provides a predetermined amount of movement of said driven armature to thereby selectively actuate the locking mechanism.

7. The power door lock actuator of claim 6, wherein said lost motion distance is at least equal to said predetermined amount of movement.

8. The power door lock actuator of claim 7, further comprising:

actuator rod means for connecting said driven armature to a door lock mechanism; and pivot connector means for pivotally connecting said actuator rod means to said driven armature.

9. The power door lock actuator of claim 8, wherein said pivot connector means comprises:

a crown at said upper portion of said driven armature;

a cap engaged on said crown, said cap having an aperture and an internal socket, wherein said aperture communicates with said internal socket; and a bulbous end of said actuator rod means which is trapped in said internal socket, wherein said actuator rod means extends outwardly from said aperture;

wherein said aperture is shaped to thereby permit said actuator rod means to pivotally tilt with respect to said crown of said upper portion of said driven armature.

10. A power door lock actuator for actuating a door lock mechanism, comprising:

a housing;

a bi-directional electric motor located in said housing;

connection means provided on said housing for connecting said electric motor to an external electrical circuit;

a threaded shaft rotatably connected with said housing, said threaded shaft having a first end and an opposite second end;

drive means for drivingly connecting said electric motor to said threaded shaft so that said electric motor provides rotation of said threaded shaft;

a drive armature axially aligned with said threaded shaft, said drive armature having head means for threadingly engaging said threaded shaft;

first abutment means located on said drive armature for providing an abutment;

a driven armature axially aligned with said threaded shaft;

second abutment means located at a first predetermined location on said driven armature for providing an abutment;

third abutment means located at a second predetermined location on said driven armature for providing an abutment, wherein said first and second predetermined locations are spaced a preselected distance apart to thereby provide a lost motion distance therebetween; and biasing means for biasing said drive armature in a first direction axially aligned with said threaded shaft and for biasing said drive armature in a second direction that is opposite said first direction, said biasing means biasing said drive armature toward a preselected neutral position;

actuator rod means for connecting said driven armature to a door lock mechanism; and pivot connector means for pivotally connecting said actuator rod to said driven armature;

wherein selected actuation of said electric motor causes selected rotation of said threaded shaft whereupon said drive armature threads with respect to said threaded shaft thereby selectively moving said drive armature axially with respect to said threaded shaft during which movement said biasing means is resiliently biased and said first abutment means abuts with one of said second and third abutment means so that said driven armature selectively moves with said drive armature;

wherein when said actuation of said electric motor ceases, said resilient biasing of said biasing means biasably repositions said drive armature to said neutral position, whereat said driven armature is freely axially movable with respect to said drive armature over said lost motion distance;

wherein said lost motion distance is defined by said driven armature moving with respect to said drive armature a distance defined by said first abutment means being relatively movable between said second and third abutment means; and wherein said pivot connector means comprises:

a crown at said upper portion of said driven armature;

a cap engaged on said crown, said cap having an aperture and an internal socket, wherein said aperture communicates with said internal socket; and a bulbous end of said actuator rod means which is trapped in said internal socket, wherein said actuator rod means extends outwardly from said aperture;

wherein said aperture is shaped to thereby permit said actuator rod means to pivotally tilt with respect to said crown of said upper portion of said driven armature.

11. A power door lock actuator for actuating a door lock mechanism, comprising:

a housing;

a bi-directional electric motor located in said housing;

connection means provided on said housing for connecting said electric motor to an external electrical circuit;

a threaded shaft rotatably connected with said housing, said threaded shaft having a first end and an opposite second end;

drive means for drivingly connecting said electric motor to said threaded shaft so that said electric motor provides rotation of said threaded shaft;

a drive armature axially aligned with said threaded shaft, said drive armature having head means for threadingly engaging said threaded shaft;

first abutment means located on said drive armature for providing an abutment;

a driven armature axially aligned with said threaded shaft;

second abutment means located at a first predetermined location on said driven armature for providing an abutment;

third abutment means located at a second predetermined location on said driven armature for providing an abutment, wherein said first and second predetermined locations are spaced a preselected distance apart to thereby provide a lost motion distance therebetween;

first spring means for biasing said drive armature in a first direction axially aligned with said threaded shaft;

second spring means for biasing said drive armature in a second direction that is opposite said first direction, said first and second springs biasing said drive armature toward a preselected neutral position;

actuator rod means for connecting said driven armature to a door lock mechanism; and pivot connector means for pivotally connecting said actuator rod means to said driven armature;

wherein selected actuation of said electric motor causes selected rotation of said threaded shaft whereupon said drive armature threads with respect to said threaded shaft thereby selectively moving said drive armature axially with respect to said threaded shaft during which movement one of said first and second springs is compressed and said first abutment means abuts with one of said second and third abutment means so that said driven armature selectively moves with said drive armature;

wherein when said actuation of said electric motor ceases, at least one of said first and second springs biasably repositions said drive armature to said neutral position, whereat said driven armature is freely axially movable with respect to said drive armature over said lost motion distance; and wherein said lost motion distance is defined by said driven armature moving with respect to said drive armature a distance defined by said first abutment means being relatively movable between said second and third abutment means;

wherein said drive armature comprises two parallel and mutually spaced apart drive armature arms connected with said head means, wherein said threaded shaft is received between said drive armature arms, further wherein said each of said drive armature arms has a distal end remote from said head means, said first abutment means being located at said distal end of each of said drive armature arms; and wherein said driven armature comprises an upper and a lower portion, wherein said lower portion comprises two parallel and mutually spaced apart driven armature arms connected with said upper portion at said third abutment means, wherein said threaded shaft is received between said driven armature arms, further wherein each of said driven armature arms has a distal end remote from said third abutment means, said second abutment means being located at said distal end of each of said driven armature arms.

12. The power door lock actuator of claim 10, wherein said drive armature arms are received between said driven armature arms; and wherein said first and second springs opposingly bias against said head means to thereby biasably position said head means at said neutral position.

13. The power door lock actuator of claim 12, wherein said first, second and third abutment means are relatively located when said head means is at said neutral position such that said selected movement of said drive armature in response to actuation of said electric motor provides a predetermined amount of movement of said driven armature to thereby selectively actuate the locking mechanism; and wherein said lost motion distance is at least equal to said predetermined amount of movement.

14.The power door lock actuator of claim 13, wherein said pivot connector means comprises:

a crown at said upper portion of said driven armature;

a cap engaged on said crown, said cap having an aperture and an internal socket, wherein said aperture communicates with said internal socket; and a bulbous end of said actuator rod means which is trapped in said internal socket, wherein said actuator rod means extends outwardly from said aperture;

wherein said aperture is shaped to thereby permit said actuator rod means to pivotally tilt with respect to said crown of said upper portion of said driven armature.

* * * * *